United States Patent [19]

Urmy, Jr.

[11] 4,409,112

[45] Oct. 11, 1983

[54] LUBRICANT, SLOW SPEED, HIGH LOAD

[75] Inventor: Charles W. Urmy, Jr., Irving, Tex.

[73] Assignee: Dresser Industries, Inc., Dallas, Tex.

[21] Appl. No.: 333,968

[22] Filed: Dec. 23, 1981

[51] Int. Cl.[3] ..... C10M 1/10; C10M 1/28

[52] U.S. Cl. ..... 252/33.4; 252/52 R; 252/25; 252/39

[58] Field of Search ..... 252/33.4, 25, 39, 52 R

[56] References Cited

U.S. PATENT DOCUMENTS

| | | | |
|---|---|---|---|
| 3,216,937 | 11/1965 | Morway et al. | 252/39 |
| 3,425,953 | 2/1969 | Cowan et al. | 252/33.4 |
| 3,472,770 | 10/1969 | Preston et al. | 252/23 |
| 3,935,114 | 1/1976 | Donaho, Jr. | 252/18 |

OTHER PUBLICATIONS

Chevron Mill Lubricants by Chevron Research Co., (Product Data Sheet).

Spent Sulphite Liquor-Sulphite Pulp Manufacturers', Research League.

Dodecanedioic Acid—Product Information by DuPont.

*Primary Examiner*—Jacqueline V. Howard

*Attorney, Agent, or Firm*—Robert D. Clamon; Fred A. Winans

[57] ABSTRACT

A heavy duty lubricating composition for lubricating metal rubbing surfaces, such as journal bearings in rock bits, is provided that forms a solid as a result of increased temperature at the areas of highest shear rate or highest loading in the bearing. The solid reverts to its original state within the carrier fluid when passing into areas of lower temperature. The composition comprises a substantially uniform dispersion within a carrier fluid of a solid additive having decreasing solubility/dispersibility in the carrier fluid as temperature increases, an additive capable of forming with the carrier fluid viscous lubricating solutions in water, and an extreme pressure agent having a high temperature of activation with the bearing materials.

19 Claims, No Drawings

LUBRICANT, SLOW SPEED, HIGH LOAD

BACKGROUND OF THE INVENTION

1. Field of the Invention

This invention relates to new lubricating compositions embodying a new mechanism of lubrication; and, more particularly, to lubricating compositions for slow speed and highly loaded bearings, such as for the highly loaded journal bearings in bits used to drill earth formations.

2. Description of the Prior Art

Lubricating a drill bit drilling in subterranean earth formations is one of the most severe and demanding set of conditions ever posed for a lubricant. The drilling takes place in an abrasive environment of mud and rock particles deep below the earth's surface. The bit is subjected to generally slow speeds and extremely high loads, sufficient to overcome the compressive strength of the rock formations in order to drill the formations. The bit most often experiences great fluctuations in load and speed as it vibrates and bounces while drilling the formation. The bearings in the bit thus are subjected to very high unit loads resulting from the loads necessary to crush the rock formation and extremely high shock loads resulting from vibration and bouncing of the drill bit. All of the horsepower delivered to the bit cutting surfaces must be delivered through the bit bearings. Thus, it can be seen that the lubricant used to lubricate the bit bearings must be capable of minimizing or preventing scoring, galling, and wear of the bearing surfaces subjected to such extreme operating conditions.

Rock bits have generally been lubricated with greases. Greases, commonly, are made by thickening an oil, generally, with a metal salt of a fatty acid, known in the art as a soap. The finished grease may also include extreme pressure additives such as lead dithiocarbamate or organic lead-sulfur compounds, anti-wear additives such as zinc dithiophosphate or antimony phosphorodithioate, anti-oxidation additives such as diphenylamine or phenothiazine, tackiness agents such as polybutene polymers or acrylate polymers, viscosity improvers such as isobytylene polymers or acrylate copolymers, and dyes. In addition, the grease may contain solid materials or fillers such as graphite, molybdenum disulfide, metal oxides, or powdered metals for improved load carrying ability by forming a solid layer interposed between the bearing surfaces.

Surface speeds in rock bit bearings are generally so slow that fluid film or hydrodynamic lubrication cannot be continuously maintained, resulting in the bearings operating in a starved-film or boundary mode of lubrication.

Lubricants using commonly available extreme pressure and anti-wear additives have yielded only slight improvements in bit bearing performance over the greases used in rock bits. That the conventional extreme pressure agents have yielded only incremental improvements in bearing performance has been attributed to the extremely severe combination of slow speeds and high unit loading commonly encountered in rock bit bearings and a very small supply of lubricant.

Subsequently, lubricants were developed utilizing increased quantities of solids or fillers in the greases. The solid was generally molybdenum disulfide. The function of the filler was to maintain a physical separation of the bearing surfaces by a low shear material. For hydrodynamic or elasto-hydrodynamic lubrication, most lubricants contain 2–5% solids, such as molybdenum disulfide. However, for successful rock bit lubrication, grease lubricants contain 10–60% solids, mainly molybdenum disulfide.

One such lubricant for a journal bearing is that described in U.S. Pat. No. 3,935,114 and generally comprises a calcium acetate complex grease with molybdenum disulfide and metallic oxides. Another such lubricant that was previously used for journal bearing rock bits included 85% of a lithium-12 hydroxystearate chassis grease and 5% by weight each of silver powder, copper powder, and graphite.

SUMMARY OF THE INVENTION

The primary object of this invention is to provide a lubricant that forms a solid as a result of increased temperature at the areas of highest shear rate or highest loading in the bearing and then upon unloading and decreased temperatures the solid reverts to its original state within the carrier fluid when passing into areas of lower shear rate. This is achieved by use of materials that are dilatant and/or inversely soluble in the bulk oil of the lubricant. A particular object of this invention is to provide a lubricating composition for lubricating slow-speed highly-loaded bearings. An important object of this invention is to provide a lubricating composition for the journal bearings or rock bits. The composition is also effective in other low speed heavy load situations as in metal forming by plastic deformation.

In accordance with this invention, the lubricating composition comprises a substantially uniform dispersion which includes a carrier fluid, a solid additive having decreasing solubility in the carrier fluid as temperature increases, an additive capable of forming with the carrier fluid viscous lubricating solutions in water, and an extreme pressure agent having a high temperature of activation with the bearing materials.

A particularly preferred embodiment of the invention includes a lubricating oil having a viscosity of 150–1000 SUS at 210 degrees F as the carrier fluid, 3–35% by weight of total composition of calcium lignosulfonate as the solid additive, 1–20% by weight of total composition of sodium fluoantimonite as the extreme pressure additive, 0.5–10% by weight of total composition of a nonionic homopolymer of ethylene oxide having a molecular weight of about 4,000,000 for the maintenance of lubricity in the presence of water, and maximum total solid content of about 65% by weight of total composition.

DESCRIPTION OF THE PEFERRED EMBODIMENTS

The lubricant of this invention is prepared by dispersing substantially uniformly in a base carrier fluid effective and synergistic amounts of an additive having decreasing solubility in the base fluid as temperature increases, an additive which forms viscous lubricating solutions in water, and an extreme pressure additive having a high activation temperature. The object of the invention is achieved by use of an additive combination such that a solid is formed at the areas of elevated temperature from increased shear rate between metal rubbing surfaces. The additive becomes re-dissolved/redispersed in the carrier fluid as the temperature decreases. The additive is chosen such that it is inversely soluble/dispersable in the base fluid with respect to temperature, i.e. as the temperature of the lubricant increases, increasing amounts of solid are precipitated or agglomerated from the carrier fluid.

Thus, as the temperature increases in the loaded area of a bearing where shear rates are highest, the additive precipitates out of solution or agglomerates together to form a solid layer at these areas of elevated temperature in the bearing, thereby forming a physical barrier to prevent contact of, and damage to, the metal bearing surfaces. Additionally, the lubricant of the invention utilizes an additive which serves as an extreme pressure agent. This additive has a relatively high temperature of activation to react with the bearing metals and form surface films to prevent damage of the metal bearing surfaces from metal to metal contact. The incorporation of this additive permits the bearing to operate at very high unit loads, especially when in conjunction with the aforementioned additive. A third additive is preferably incorporated which serves to maintain lubricity if water contaminates the lubricant in a rock bit during its use in a downhole environment if a seal should leak.

A first series of lubricants was prepared based on the following composition:

(a) a base carrier fluid of lubricating oil (b) a metal lignosulfonate as the solid additive (c) an alkali metal fluoantimonite as the extreme pressure additive, and (d) a nonionic homopolymer of ethylene oxide for increased water tolerance.

The carrier fluid is a hydrocarbon oil prepared from high viscosity index base stocks and contains no lead. It is a tenacious, high viscosity, extreme pressure oil. It is extremely adhesive and tenacious making it suitable for lubrication of gears or other equipment in a wet environment. Its viscosity at 100 degrees F is 43,000 SUS and at 210 degrees F is 666 SUS. Such an oil is commercially available as Chevron Mill Lube Heavy.

The solid additive is a metal lignosulfonate. Initially it was felt that the metal lignosulfonate would form viscous solutions in water that would have some lubricity. Thus, including a metal lignosulfonate in the formula would allow the maintenance of lubricity in the presence of water. However, upon experimentation, other properties of this additive were realized. It was found that the material provides superior lubricating performance over molybdenum disulfide, in four ball EP testing, in several experimental formulae. It was subsequently determined that the metal lignosulfonate has some solubility or disperability in cold oil but the solubility or dispersability decreases as temperature increases such that it precipitates out or agglomerates at the elevated temperatures (i.e. a threshold temperature in the range of 150–350 degrees F dependent on the carrier fluid). Thus, as the lubricant in the bearing enters the area of high shear rate the temperature increases and some portion of the metal lignosulfonate will precipitate out or coagulate as a solid, forming a solid physical barrier between the parts of the bearing. Such a physical barrier greatly reduces or prevents the metal to metal contact at the bearing surface asperities which approach most closely under heavy bearing loads. Upon passing through an area of high shear rate, the lubricant cools below the threshold temperature and the metal lignosulfonate will then re-dissolve or re-disperse in the oil. The metal lignosulfonate of the preferred formulation was available from Magcobar Division of Dresser Industries, Inc. under the trade name of Magcopel.

The extreme pressure additive of an alkali metal fluoantimonite was preferably sodium fluoantimonite ($NaSbF_4$) available from Harshaw Chemical Company. It has a high activation temperature, i.e. about 600 degrees F, and permits very high unit pressures, especially in small contact areas. Sodium fluoantimonite, included in the lubricant, gives extremely high non-welding loads on the 4 ball EP testing machine. Passing loads of 2400–2600 kg are common with the highest passing load at 3115 kg. Sodium fluoantimonite is useful in new plain bearings where the mating surfaces are not conditioned, thus "break-in" time is greatly reduced.

The nonionic homopolymer of ethylene oxide used as a water tolerance additive is available from Union Carbide as Polyox WSR-301. Polyox WSR-301 forms viscous solutions in water and such solutions display dilatant properties. Polyox WSR-301 serves to maintain lubricity if water contaminates the lubricant.

This first series of lubricants resulted in two preferred formulations:

| | Formula A | Formula B |
|---|---|---|
| Chevron Mill Lube Heavy | 76.0% | 75.0% |
| Calcium Lignosulfonate | 10.1% | 10.0% |
| Sodium Fluoantimonite | 10.1% | 10.0% |
| Polyox WSR-301 | 3.8% | 4.0% |
| Armid C (a fatty amide with properties as discussed subsequently) | — | 1.0% |

Formula A is thick and viscous, but over a period of time, some settling of the solids in the carrier fluid may take place. The Armid C in formula B serves to increase the yield value (i.e. initial resistance to flow) and the settling of solids is greatly retarded. Although the above formulations were preferred, it is felt that acceptable performance of the lubricant is obtained wherein the minimum and maximum amounts of materials are in the range of:

3.0 to 35% for calcium lignosulfonate;

0 to 20% for sodium fluoantimonite;

0 to 10% for WSR-301; and the balance is oil.

It is also felt that the maximum limit of total solids in the lubricant should not exceed about 65%.

Armid C is a fatty amide available from the Chemicals Division of the Armak Company with the following properties.

| AVERAGE COMPOSITION (%) | Amide | Carbon Chain Length | ARMID C |
|---|---|---|---|
| SPECIFICATIONS | Octanamide | 8 | 8 |
| | Decanamide | 10 | 7 |
| | Dodecanamide | 12 | 49 |
| | Tetradecanamide | 14 | 17 |
| | Pentadecanamide | 15 | |
| | Hexadecanamide | 16 | 9 |
| | Heptadecanamide | 17 | |
| | Octadecanamide | 18 | 2 |
| | 9-Octadecenamide | 18 | 6 |
| | 9–12 Octadecadienamide | 18 | 2 |
| | Others | | |
| | Amide % | min | 90 |
| | | max | |
| | Iodine value | min | |
| | | max | 10 |
| | Free fatty acid % | min | |
| | | max | 4 |
| | Melting point °C. | min | 85 |
| | | max | |

-continued

| AVERAGE COMPOSITION (%) | Amide | Carbon Chain Length | ARMID C |
|---|---|---|---|
| | Color gardner | min | |
| | | max | 10 |
| | Moisture % | min | |
| | | max | 0.5 |
| TYPICAL PROPERTIES | Flash point °C., Approx. | | ¼ |
| | Fire point °C., Approx. | | 185 |
| | Form | | flake |

Formula A may be prepared by simply mixing the components. No heat is necessary. Formula B must be heated to 175 degrees F to melt the Armid C, with stirring until the temperature decreases to 125 degrees F. Four ball EP test data are shown below:

| MATERIAL | WELD POINT kg | PASS LOAD kg | WEAR SCAR mm |
|---|---|---|---|
| Formula A | 1000+ | 1000 | 2.4 |
| Formula B | 1000+ | 1000 | 2.3 |
| Chevron Mill Lube Heavy | 400 | 315 | 2.5 |

The four ball EP test data was acquired using ASTM test procedure D-2783-71 (See ASTM Standards, Part 24).

The next series of lubricants were prepared with other metal lignosulfonates. These metal lignosulfonates were prepared as follows:

a. Treating calcium lignosulfonate solution with sulfuric acid thus forming lignosulfonic acid and calcium sulfate.

b. Allowing the precipitate of calcium sulfate to settle.

c. Separating the lignosulfonic acid solution from the calcium sulfate.

d. Reacting the lignosulfonic acid solution with the desired metal hydroxide or oxide.

e. Evaporating the metal lignosulfonate to dryness at 250–275 degrees F.

f. Grinding the product to a fine powder.

The prepared lignosulfonates were evaluated in two ways, in the four ball EP test machine.

a. As an additive, at 10%, in a lithium 12-hydroxystreate grease (Shell Alvania #2 available from Shell Oil Company)

b. As a replacement for Magcopel (calcium lignosulfonate) in formula A at a 10.1% level.

| | Lignosulfonates, at 10% in Shell Alvania #2, | | | | | | | |
|---|---|---|---|---|---|---|---|---|
| | C | D | E | F | G | H | I | J |
| Shell Alvania #2 | 90.0 | 90.0 | 90.0 | 90.0 | 90.0 | 90.0 | 90.0 | 90.0 |
| Sodium | 10.0 | | | | | | | |
| Aluminum | | 10.0 | | | | | | |
| Titanium | | | 10.0 | | | | | |
| Antimony | | | | 10.0 | | | | |
| Silver | | | | | 10.0 | | | |
| Copper | | | | | | 10.0 | | |
| Cobalt | | | | | | | 10.0 | |
| Nickel | | | | | | | | 10.0 |

Test results of the above metal lignosulfonates when added to a lithium 12-hydroxysterate grease (Shell Alvania #2):

| | C | D | E | F | G | H | I | J | Shell Alvania #2 |
|---|---|---|---|---|---|---|---|---|---|
| Avg. weld point (kg) | 250 | 400 | 400 | 400 | 500 | 500 | 400 | 315 | 160 |
| Avg. hi load (kg) | 200 | 315 | 315 | 315 | 400 | 400 | 315 | 250 | 126 |
| Avg. scar (mm) | 1.35 | 2.2 | 1.8 | 2.55 | 2.25 | 2.6 | 1.95 | 2.25 | 2.6 |

Other metal lignosulfonates, in place of calcium lignosulfonate, in formula A.

| | & | | | | | | | |
|---|---|---|---|---|---|---|---|---|
| | K | L | M | N | P | Q | R | T |
| Mill lube Heavy | 76.0 | 76.0 | 76.0 | 76.0 | 76.0 | 76.0 | 76.0 | 76.0 |
| ($NaSbF_4$) | 10.1 | 10.1 | 10.1 | 10.1 | 10.1 | 10.1 | 10.1 | 10.1 |
| MAGCOPEL | — | — | — | — | — | — | — | — |
| Polyox WSR-301 | 3.8 | 3.8 | 3.8 | 3.8 | 3.8 | 3.8 | 3.8 | 3.8 |
| Aluminum L | 10.1 | | | | | | | |
| Titanium L | | 10.1 | | | | | | |
| Antimony L | | | 10.1 | | | | | |
| Silver L | | | | 10.1 | | | | |
| Copper L | | | | | 10.1 | | | |
| Cobalt L | | | | | | 10.1 | | |
| Nickel L | | | | | | | 10.1 | |
| Sodium L | | | | | | | | 10.1 |
| Test results: | | | | | | | | |
| Avg. weld point (kg) | 1000+ | 1000+ | 1000+ | 1000+ | 1000+ | 1000+ | 1000+ | 1000+ |
| Avg. hi load (kg) | 1000 | 1000 | 1000 | 1000 | 1000 | 1000 | 1000 | 1000 |
| Avg. scar (mm) | 2.2 | 2.15 | 2.15 | 2.35 | 2.4 | 2.5 | 2.5 | 2.45 |

The next series of lubricants were formulated by changing the carrier fluid used in formulation A. In this series the Magcopel is 10.1%, the $NaSbF_4$ is 10.1%, and the Polyox WSR-301 is 3.8%. The carrier fluids are used at 76.0%. The fluids tested are as follows:

| Carrier Fluid | Commercial Designation | Manufacturer |
|---|---|---|
| Mineral Oil | Mill Lube Heavy | Chevron |
| Polyalphaolefin | PAO-40C | Uniroyal |
| Polyalphaolefin | PAO-60C | Uniroyal |
| Napthenic Mineral Oil | WF-240 | Calumet |
| Napthenic Mineral Oil | Circosol 5600 | Sun Oil Co. |
| Synthetic Hydrocarbon | SHC-634 | Mobil Oil Co. |
| Aromatic Synthetic Oil | Alkylate N-600 | Conoco |
| Aromatic Synthetic Oil | Alkylate DN-600 | Conoco |
| Diester Oil | Ortholeum 5000 | Dupont |

Since the concentration of Magcopel, $NaSbF_4$, and Polyox are held constant in this series, the results listed in the following table are listed by the oil used.

| Oil | Weld Point (kg) | Hi-load (kg) | Scar (mm) |
|---|---|---|---|
| Mill Lube Hvy. | 1000+ | 1000 | 2.4 |
| PAO-40C | 1000+ | 1000 | 2.9 |
| PAO-60C | 1000+ | 1000 | 2.2 |
| WF-240 | 1000+ | 1000 | 2.1 |
| Circosol 5600 | 1000+ | 1000 | 2.3 |
| SHC-634 | 1000+ | 1000 | 2.4 |
| Alkylate N-600 | 1000 | 800 | 2.7 |
| Alkylate DN-600 | 1000+ | 1000 | 2.4 |
| Ortholeum 5000 | 1000+ | 1000 | 1.9 |

The above data indicates excellent four ball performances in all of the oils tried. For comparison the four ball performances of the neat oils are shown in the table that follows:

| Oil | Weld Point (kg) | Hi-load (kg) | Scar (mm) |
|---|---|---|---|
| Mill Lube Hvy | 400 | 315 | 2.5 |
| PAO-40C | 100 | 80 | 3.1 |
| PAO-60C | 126 | 100 | 3.1 |
| WF-240 | 126 | 100 | 2.9 |
| Circosol 5600 | 100 | 80 | 2.7 |
| SHC-634 | 100 | 80 | 3.1 |
| Alkylate N-600 | 126 | 100 | 1.9 |
| Alkylate DN-600 | 100 | 80 | 3.0 |
| Ortholeum 5000 | 100 | 80 | 2.5 |

The following table illustrates the performance of the Magcopel, $NaSbF_4$, Polyox additive package at differing concentration levels in the Ortholeum 5000 (a diester oil by Dupont):

| Magcopel | $NaSbF_4$ | Polyox WSR-301 | Weld Point (kg) | Hi-load (kg) | Scar (mm) |
|---|---|---|---|---|---|
| 10.1% | 10.1% | 3.8% | 1000+ | 1000 | 1.9 |
| 5.05% | 5.05% | 1.9% | 1000+ | 1000 | 2.1 |
| 2.5% | 2.5% | 0.95% | 1000+ | 1000 | 2.2 |

Although the four ball performance is decreasing as the package level decreases, as indicated by the scar values, the performances are still very high.

The four ball performances of the Magcopel, $NaSbF_4$, Polyox package in the hydrocarbon oil, Chevron Mill Lube Heavy, are very high; but, nevertheless, they are concentration dependent. The table below shows the four ball performances versus concentration:

| Component | % | | | |
|---|---|---|---|---|
| Mill Lube Heavy | 76.0 | 82.0 | 88.0 | 94.0 |
| Magcopel | 10.0 | 7.5 | 5.0 | 2.5 |
| $NaSbF_4$ | 10.0 | 7.5 | 5.0 | 2.5 |
| Polyox WSR-301 | 4.0 | 3.0 | 2.0 | 1.0 |
| Weld Point (kg) | 1000+ | 1000+ | 1000+ | 1000+ |
| Hi-load (kg) | 1000 | 1000 | 1000 | 1000 |
| Scar (mm) | 2.3 | 2.4 | 2.5 | 2.6 |

The following table illustrates the performance of the Magcopel, $NaSbF_4$, Polyox additive package when added to water as the carrier fluid:

| | % | | | | | | |
|---|---|---|---|---|---|---|---|
| Water | 100 | 90.0 | 90.0 | 90.0 | 90.0 | 95.0 | 80.0 |
| Magcopel | — | 5.0 | — | 5.0 | — | — | 5.0 |
| Polyox | — | 5.0 | 5.0 | — | 10.0 | 5.0 | 5.0 |
| $NaSbF_4$ | — | — | 5.0 | — | — | — | 10.0 |
| Weld Point (kg) | 100 | 250 | 620 | 400 | 160 | 160 | 1000 |
| Hi-load (kg) | 80 | 200 | 500 | 315 | 126 | 126 | 800 |
| Scar (mm) | 2.2 | 1.6 | 1.4 | 1.2 | 2.0 | 2.0 | 2.0 |

The following lubricant formulations were prepared and tested to evaluate the performance of potassium fluoantimonite, $KSb_2F_7$, and potassium fluoantimonate, $KSbF_4$, both commercially available from Harshaw Chemical Co., in place of the sodium fluoantimonite in formula A.

| Component | % | |
|---|---|---|
| Chevron Mill Lube Heavy | 76 | 76 |
| Potassium fluoantimonite | 10.1 | — |
| Potassium fluoantimonite | — | 10.1 |
| Magcopel | 10.1 | 10.1 |
| Polyox WSR-301 | 3.8 | 3.8 |
| Weld Point (kg) | 1000+ | 1000+ |
| High-Load (kg) | 1000 | 1000 |
| Scar (mm) | 2.4 | 2.75 |

The next series of lubricants were formulated using calcium dodecanedioate, $[CaOOC(CH_2)_{10}COO]_n$. Calcium dodecandioate, up to at least 20% concentration, will dissolve or disperse readily in mineral oils. When dissolved or dispersed in Circosol 5600 the calcium dodecanedioate will begin to precipitate (or coagulate) as a solid at temperatures of about 325 degrees F. Further temperature increases will cause more calcium dodecanedioate to precipitate out. Upon cooling the calcium dodecandioate will re-dissolve (or re-disperse).

The calcium dodecanedioate is prepared in situ in the carrier fluid by mixing together the necessary portions of Dodecanedioic acid and Calcium hydroxide in the carrier fluid. The mixture is stirred while heating. The heat is gradually increased to about 250 degrees F maximum until foaming ceases. The heating is then discontinued but the mixture is stirred until the temperature decreases to about 150 degrees F. This procedure reacts the calcium hydroxide and dodecanedioic acid to form calcium dodecanedioate and water, which is driven off during the heating cycle. The Dodecanedioic acid was obtained from the Petrochemicals Department Intermediates Division of E. I. DuPont de Nemours & Co. (Inc.). The Dodecanedioic acid has the following specifications:

| SPECIFICATIONS | |
|---|---|
| 1, 12-Dodecanedioic Acid | 98.0 Wt. % Maximum |
| Water | 0.5 Wt. % Maximum |
| Ash | 20 ppm Maximum |
| GENERAL INFORMATION | |
| Monobasic Acid | 0.1 Wt. % Maximum |
| Iron | 2 ppm Maximum |
| Melting Point | 130 ± 1 degree C. |
| Specific Gravity (25 degrees C.) | 1.15 |
| Solubility in Water (80 degrees C.) | 0.1 Wt. % |
| Color (APHA) - Two Grams in 50 ml. Methanol | 10 |

The following table gives the necessary percentages of each of the ingredients to result in the indicated levels of the calcium dodecanedioate soap:

| Ingredient | 20% Soap | 10% Soap | 5% Soap | 2.5% Soap |
|---|---|---|---|---|
| Oil | 77.9% | 88.9% | 94.4% | 97.2% |
| Dodecanedioic Acid | 16.7% | 8.4% | 4.2% | 2.1% |
| Calcium Hydroxide | 5.4% | 2.7% | 1.4% | 0.7% |

The following data demonstrates that calcium dodecanedioate can function as a solid additive in a variety of oils. Since the calcium dodecandioate level, at 5%, is constant, the four ball performances are listed by the oil. The results are shown in the table below:

| OIL | WP (kg) | HI LOAD (kg) | SCAR (mm) |
|---|---|---|---|
| PAO-40C | 500 | 400 | 1.5 |
| PAO-60C | 400 | 315 | 2.1 |
| WF-240 | 800 | 620 | 1.8 |
| SHC-634 | 500 | 400 | 2.1 |
| Alkylate N-600 | 400 | 315 | 1.9 |
| Alkylate DN-600 | 315 | 250 | 1.9 |
| Mill Lube Hvy. | 800 | 620 | 1.9 |

The above data indicate that calcium dodecanedioate will significantly increase the four ball performances of the oils used.

The four ball performance of calcium dodecanedioate in Circosol 5600 is, to a large measure, dependent upon the quantity used. The table below shows the effect of four ball performance versus calcium dodecanedioate level. Since the same materials are used but the percentages are different the four ball performances are listed by the calcium dodecanedioate concentration:

| Calcium Dodecanedioate | WP (kg) | Hi Load (kg) | Scar (mm) |
|---|---|---|---|
| 30% | 500 | 400 | 1.4 |
| 20% | 620 | 500 | 1.1 |
| 15% | 800 | 620 | 1.3 |
| 10% | 800 | 620 | 1.4 |
| 5% | 800 | 620 | 1.5 |
| 3% | 500 | 400 | 2.2 |
| 2% | 315 | 250 | 2.9 |
| 1% | 200 | 160 | 2.8 |

The above data indicated that 5–15% level of calcium dodecanedioate is optimum. Four ball performance decreases at concentration levels of 20–30% and also decreases at levels of less than 5%. At concentration levels of less than 5%, solubility limits cannot be as effectively exceeded and so four ball performance decreases. At the 30% level, the solids content is excessive.

Calcium dodecanedioate will improve the four ball performance of water. The table below compares the four ball performance of water and a mixture of 20% calcium dodecanedioate and 80% water.

| | Water | 20% Calcium dodecanedioate, 80% Water |
|---|---|---|
| WP (kg) | 100 | 620 |
| Hi Load (kg) | 80 | 500 |
| Scar (mm) | 2.2 | 1.4 |

Thus, it is seen that calcium dodecanedioate will function as a lubricant or a physical barrier between metal rubbing surfaces even in the presence of water.

I claim:

1. A heavy duty lubricating composition comprising a solution or mixture including:
   a carrier fluid;
   a metal lignosulfonate dissolved or dispersed therein;
   an alkali metal fluoantimonite; and,
   a nonionic homopolymer of ethylene oxide having a molecular weight of 400,000 to 5,000,000.

2. A heavy duty lubricating composition comprising a solution or a substantially uniform dispersion including:
   a hydrocarbon lubricating oil as a carrier fluid;
   a metal lignosulfonate;
   an alkali metal fluoantimonite; and,
   a nonionic homopolymer of ethylene oxide having a molecular weight of 400,000 to 5,000,000.

3. A heavy duty lubricating composition comprising a solution or a substantially uniform dispersion including:
   a hydrocarbon lubricating oil;
   a metal lignosulfonate, wherein the metal is selected from the group consisting of calcium, barium, zinc, tin, lead, iron, beryllium, magnesium, sodium, aluminum, titanium, antimony, silver, copper, cobalt, and nickel;
   an alkali metal fluoantimonite, wherein the metal is selected from the group consisting of sodium and potassium; and,
   a nonionic homopolymer of ethylene oxide having its molecular weight in the range from 400,000 to 5,000,000.

4. The lubricating composition of claim 3 wherein:
   the metal lignosulfonate is calcium lignosulfonate; and,
   the alkali metal fluoantimonite is sodium fluoantimonite.

5. The lubricating composition of claim 4 wherein the calcium lignosulfonate is present in an amount of 3–35 percent by weight of total composition.

6. The lubricating composition of claim 4 wherein the sodium fluoantimonite is present in an amount of 1–20 percent by weight of total composition.

7. The lubricating composition of claim 4 wherein the nonionic homopolymer of ethylene oxide is present in an amount of 0.5–10 percent by weight of total composition and has a molecular weight of about 4,000,000.

8. The lubricating composition of claim 4 wherein the oil has a viscosity of 150–1000 SUS at 210 degrees F.

9. The lubricating composition of claim 4 wherein:
   the oil has a viscosity of 150–1000 SUS at 210 degrees F;

the calcium lignosulfonate is present in an amount of 3–35 percent by weight of total composition;

the sodium fluoantimonite is present in an amount of 1–20 percent by weight of total composition;

the nonionic homopolymer of ethylene oxide is present in an amount of 0.5–10 percent by weight of total composition and has a molecular weight of about 4,000,000; and, the maximum total solids is about 65 percent by weight of total composition.

10. The lubricating composition of claim 4 wherein:

the oil has a viscosity of about 666 SUS at 210 degrees F;

the calcium lignosulfonate is present in the amount of about 10.1 percent by weight of total composition;

the sodium fluoantimonite is present in the amount of about 10.1 percent by weight of total composition; and the nonionic homopolymer of ethylene oxide is present in the amount of about 3.8 percent by weight of total composition.

11. A heavy duty lubricating composition comprising a substantially uniform dispersion including:

a hydrocarbon lubricating oil;

a metal lignosulfonate, wherein the metal is selected from the group consisting of calcium, barium, zinc, tin, lead, iron, beryllium, magnesium, sodium, aluminum, titanium, antimony, silver, copper, cobalt, and nickel;

an alkali metal fluoantimonite, wherein the metal is selected from the group consisting of sodium and potassium;

a nonionic homopolymer of ethylene oxide having its molecular weight from 400,000 to 5,000,000; and, a fatty amide having from 12 to 20 carbon atoms.

12. The lubricating composition of claim 11 wherein:

the metal lignosulfonate is calcium lignosulfonate; and, the alkali metal fluoantimonite is sodium fluoantimonite.

13. The lubricating composition of claim 12 wherein the calcium lignosulfonate is present in an amount of 3–35 percent by weight of total composition.

14. The lubricating composition of claim 12 wherein the sodium fluoantimonite is present in an amount of 1–20 percent by weight of total composition.

15. The lubricating composition of claim 12 wherein the nonionic homopolymer of ethylene oxide is present in an amount of 0.5–10 percent by weight of total composition and has a molecular weight of about 4,000,000.

16. The lubricating composition of claim 12 wherein the oil has a viscosity of 150–1000 SUS at 210 degrees F.

17. The lubricating composition of claim 12 wherein the fatty amide is present in an amount of 0.5–5 percent by weight of total composition.

18. The lubricating composition of claim 12 wherein:

the calcium lignosulfonate is present in an amount of 3–35 percent by weight of total composition;

the sodium fluoantimonite is present in an amount of 1–20 percent by weight of total composition;

the nonionic homopolymer of ethylene oxide is present in an amount of 0.5–10 percent by weight of total composition and has a molecular weight of about 4,000,000;

the oil has a viscosity of 150–1000 SUS at 210 degrees F;

the fatty amide is present in an amount of 0.5–5 percent by weight of total composition; and, the maximum total solids is about 65 percent by weight of total composition.

19. The lubricating composition of claim 12 wherein:

the oil has a viscosity of about 666 SUS at 210 degrees F;

the calcium lignosulfonate is present in the amount of about 10 percent by weight of total composition;

the sodium fluoantimonite is present in the amount of about 10 percent by weight of total composition;

the nonionic homopolymer of ethylene oxide is present in the amount of about 4.0 percent by weight of total composition; and, the fatty amide is present in an amount of about 1 percent by weight of total composition.

* * * * *